US006098355A

United States Patent [19]

Li

[11] Patent Number: 6,098,355

[45] Date of Patent: Aug. 8, 2000

[54] SLIDING-TYPE WINDOW FRAME FOR MOUNTING A WINDOW PANEL ASSEMBLY

[76] Inventor: Ching-Chi Li, No. 81, Lane 56, Ta-Chung Erh Rd., Tso-Ying Dist., Kaohsiung, Taiwan

[21] Appl. No.: 09/208,038

[22] Filed: Dec. 9, 1998

[51] Int. Cl.[7] ..... E06B 9/92

[52] U.S. Cl. ..... 52/212; 52/217; 52/209; 52/204.6; 52/204.56

[58] Field of Search ..... 52/212, 217, 209, 52/204.56, 204.6, 204.5

[56] References Cited

U.S. PATENT DOCUMENTS

| | | | |
|---|---|---|---|
| 1,334,398 | 1/1920 | Barclay | 52/209 |
| 2,169,865 | 8/1939 | Banta | 52/217 X |
| 2,619,687 | 12/1952 | Kahn | 52/217 |
| 2,700,441 | 1/1955 | Cudini | 52/217 X |
| 2,791,007 | 5/1957 | Kobil et al. | 52/212 |
| 3,553,891 | 1/1971 | Casebolt et al. | 52/217 X |
| 3,793,788 | 2/1974 | Collins | 52/217 X |
| 3,906,671 | 9/1975 | Maldonado | 52/212 X |
| 4,523,408 | 6/1985 | McConnell | 52/212 X |
| 5,477,644 | 12/1995 | Chenoweth, Jr. | 52/217 X |
| 5,956,909 | 9/1999 | Chou | 52/209 |

FOREIGN PATENT DOCUMENTS

| | | | |
|---|---|---|---|
| 588730 | 12/1959 | Canada | 52/212 |

*Primary Examiner*—Carl D. Friedman
*Assistant Examiner*—Phi Dieu Tran A
*Attorney, Agent, or Firm*—Fish & Richardsom P.C.

[57] ABSTRACT

A sliding-type window frame includes a jamb frame assembly having a top jamb member, a bottom jamb member spaced apart from the top jamb member in a longitudinal direction, and left and right upright side jamb members spaced apart from each other in a transverse direction and interconnected to the top and bottom jamb members. The top jamb member has a top channel body that confines a space for receiving a top end of a window panel and that has two opposite ends connected to the side jamb members respectively, and a sash plate that extends between the side jamb members and that is mounted movably in the top channel body so as to be movable in the space between lower and upper positions. The sash plate has a lower surface formed with at least one track member to engage the top end of the window panel when the sash plate is at the lower position. The track member is disposed to be spaced away from the top end of the window panel when the sash plate is at the upper position to facilitate loading and unloading of the window panel into and from the jamb frame assembly.

11 Claims, 9 Drawing Sheets

SLIDING-TYPE WINDOW FRAME FOR MOUNTING A WINDOW PANEL ASSEMBLY

BACKGROUND OF THE INVENTION

1. Field of the Invention

The invention relates to a window frame, more particularly to a sliding-type window frame having a top jamb member with sliding tracks which are disengageable from a window panel.

2. Description of the Related Art

Referring to FIG. 1, a conventional sliding-type window frame 1 is shown to include top and bottom jamb members 14, 15 spaced from each other in a longitudinal direction for slidable mounting of outer and inner window panels 12, 13 and a window screen 11. In order to achieve a waterproofing effect, the bottom jamb member 15 has a water baffle 151 which is twice as high as an inner rail 152 that, in turn, is disposed higher than an outer rail 153. A drawback results in that the outer window panel 12 must be loaded or unloaded before the inner window panel 13 due to the higher water baffle 151. Thus, the operator has to work from the inside of the window through a limited passage opening of the window frame, due to the presence of the inner window panel 13. This results in inconveniences and can increase the risk of dropping of the window panels from the operator's hands.

SUMMARY OF THE INVENTION

Therefore, the object of this invention is to provide a sliding-type window frame which permits a window panel assembly to be installed conveniently while maintaining a good waterproofing effect.

Accordingly, the sliding-type window frame for mounting a window panel assembly of this invention includes a jamb frame assembly having a top jamb member, a bottom jamb member spaced apart from the top jamb member in a longitudinal direction, and left and right upright side jamb members spaced apart from each other in a transverse direction relative to the longitudinal direction and interconnected to the top and bottom jamb members. The top jamb member has a top channel body that confines a space for receiving a top end of the window panel assembly and that has two opposite ends connected to the side jamb members respectively, and a sash plate that extends between the side jamb members and that is mounted movably in the top channel body so as to be movable in the space between lower and upper positions. The sash plate has a lower surface formed with at least one track member adapted to engage the top end of the window panel assembly when the sash plate is at the lower position. The track member is disposed to be spaced away from the top end of the window panel assembly when the sash plate is at the upper position to facilitate loading and unloading of the window panel assembly into and from the jamb frame assembly.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
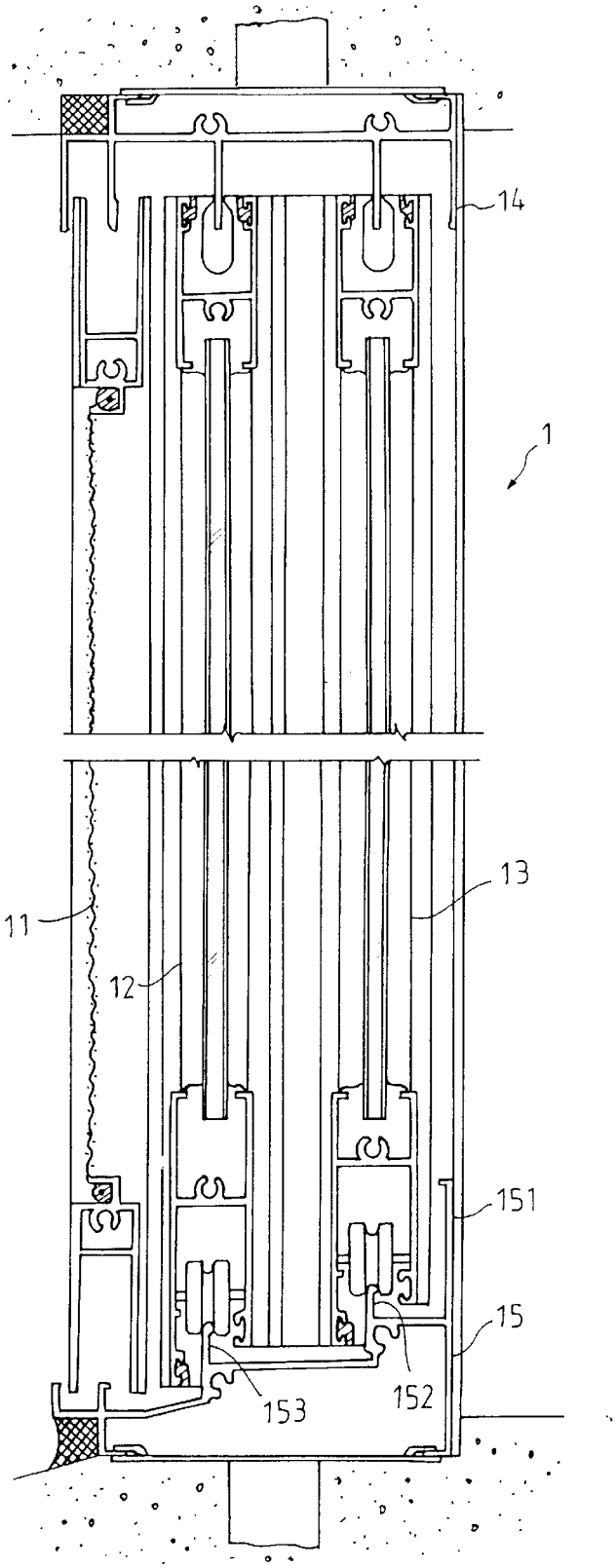
FIG.1 PRIOR ART
FIG. 1 is a side view showing a conventional sliding-type window frame.
Figure 2:
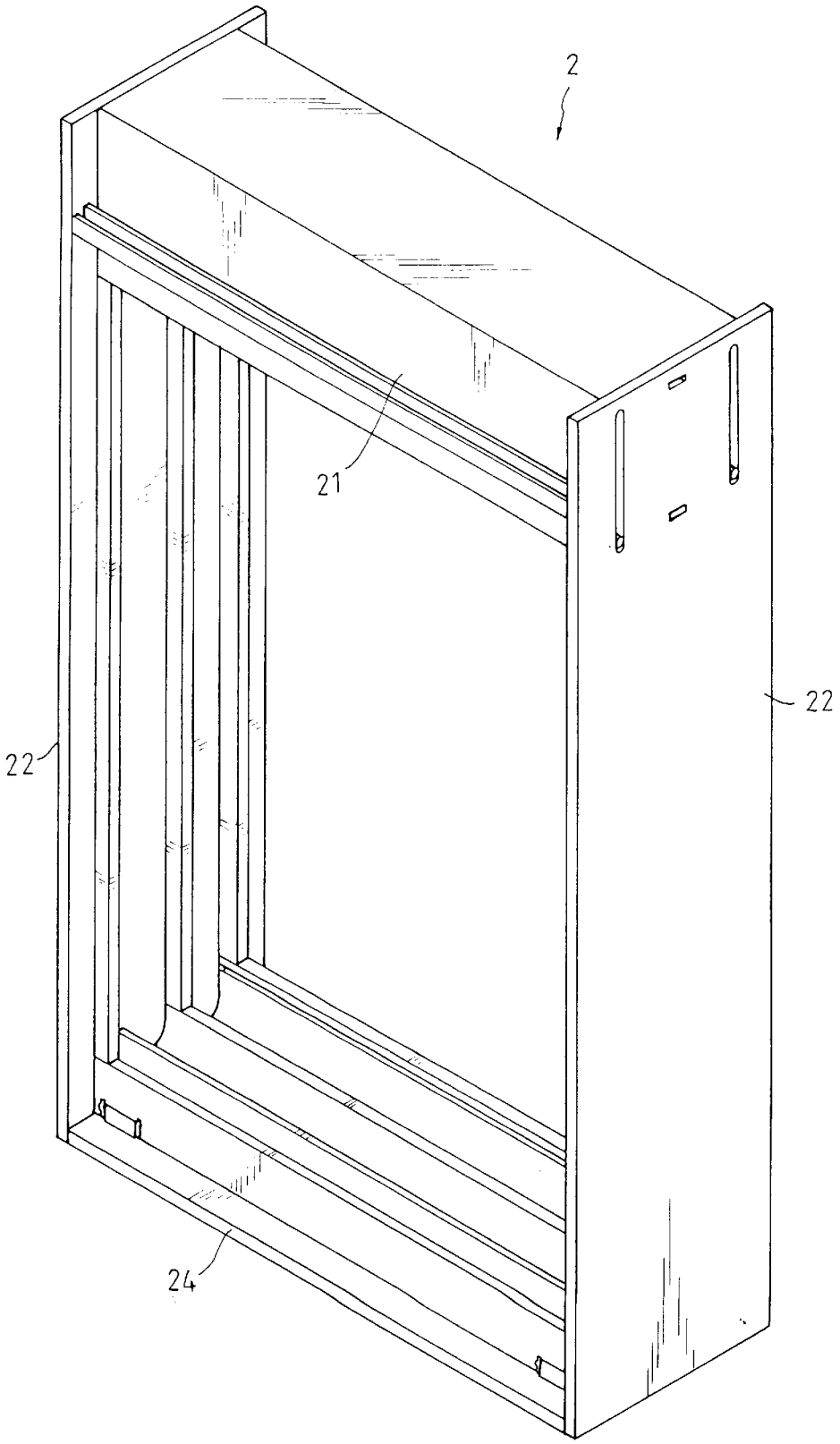
FIG. 2 is a perspective view of a preferred embodiment of a sliding-type window frame of this invention.

Referring to FIG. 2, a first preferred embodiment of a sliding-type window frame according to this invention is used for mounting a window panel assembly, and includes a jamb frame assembly which is shown to comprise a top jamb member 21, a bottom jamb member 24 spaced from the top jamb member 21 in a longitudinal direction, and two upright side jamb members 22 that are spaced from each other in a transverse direction and that interconnect the top and bottom jamb members 21, 24 to form the jamb frame assembly.

Figure 3:
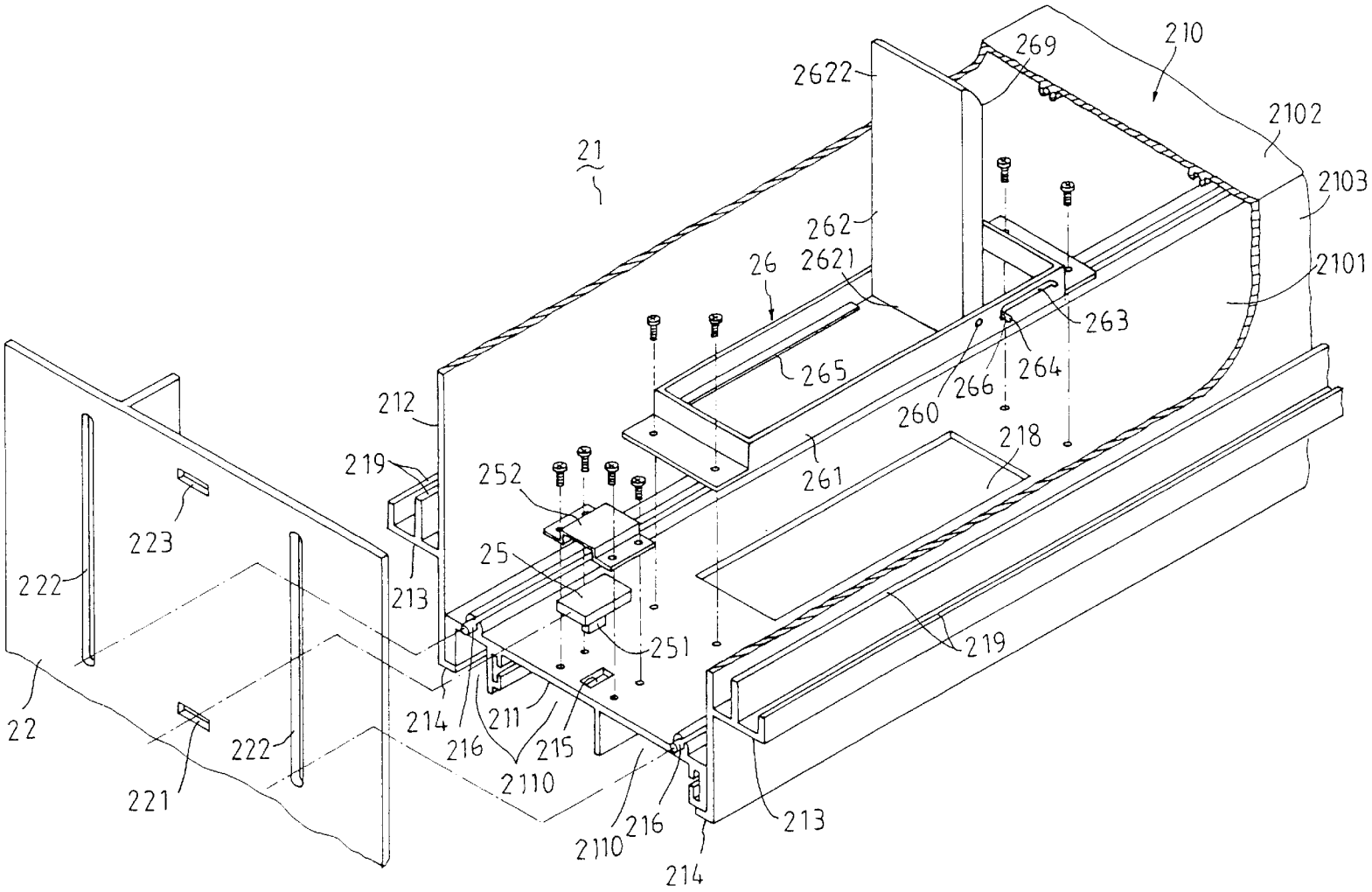
FIG. 3 is a fragmentary sectional view of a top jamb member employed in the preferred embodiment.

Referring to FIG. 3, the top jamb member 21 has a top channel body 210 that confines a space 2101 adapted for receiving a top end of the window panel assembly and that has two opposite ends connected to the side jamb members 22 respectively, and a sash plate 211 which extends between the side jamb members 22 and which is mounted movably in the top channel body 210 so as to be movable in the space 2101 along the longitudinal direction between lower and upper positions.

The top channel body 210 has a top wall 2102 which is disposed above the sash plate 211, and two opposite guide walls 2103 which extend downwardly from two opposite ends of the top wall 2102. The guide walls 2103 have inwardly projecting end flanges 214. The sash plate 211 is therefore movable between the end flanges 214 and the top wall 2102 so as to dispose the same at the lower and upper positions. Two integral anchor seats 213 extend outwardly from the guide walls 2103 respectively, and have a plurality of integral anchor members 219 which extend upwardly from the anchor seats 213 to provide anchorage between a concrete structure 5 and the top jamb member 21, as best shown in FIG. 6.

Figure 6:
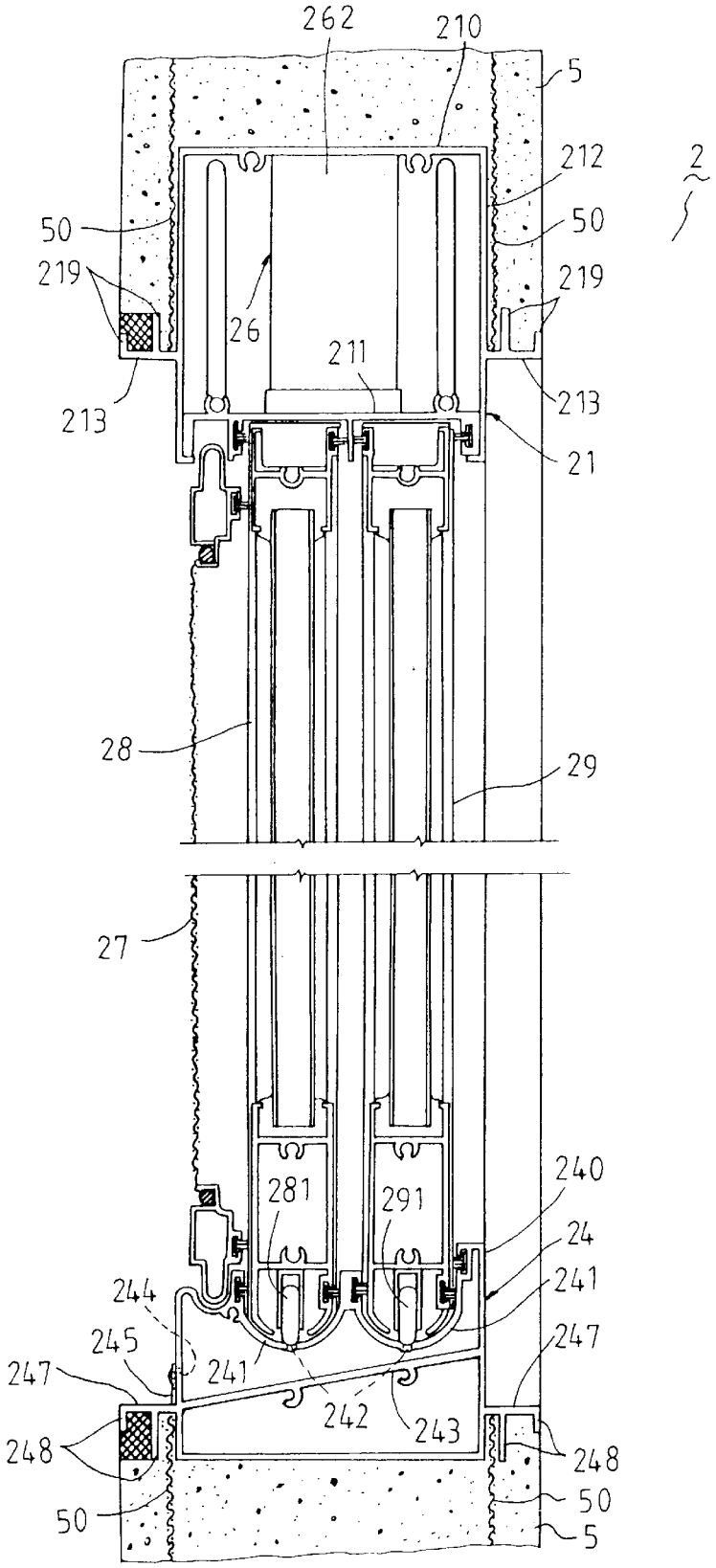
FIG. 6 is a side view of the preferred embodiment.

The sash plate 211 has a lower surface formed with three track members 2110 adapted for guiding and holding the top ends of the window panels 28, 29 and a window screen 27 (see FIG. 6). The sash plate 211 further has two latch mounting holes 215 (only one is shown) proximate to the side jamb members 22, respectively.

In this embodiment, a latch mechanism is used for positioning the sash plate 211 at the lower and upper positions. The latch mechanism includes a latch member 25 which has a handle portion 251 mounted slidably in the latch mounting hole 215. By manipulating the handle portion 251, one may slide the latch member 25 to move limitedly in the transverse direction for inserting into one of the lower and upper latch holes 221, 223 which are formed in each of the side jamb members 22. As such, the sash plate 211 can be positioned at the lower position, where the latch member 25 extends into the lower latch hole 221, or at the upper position, where the latch member 25 extends into the upper position (see FIG. 5). When the sash plate 211 is at the upper position, the track members 2110 are moved away from the top ends of the window panels 28, 29 and the window screen 27 so that the window panel 28, 29 can be easily attached to and detached from the jamb frame assembly 2. In addition, a guide in the form of two longitudinal slots 222 are formed in each of the side jamb members 22. Two elongate engaging members 216 project from two opposite ends of the sash plate 211 toward the side jamb members 22 for sliding in the guide slots 222, thereby guiding the sash plate 211 to move in the longitudinal direction without tilting.

Figure 5:
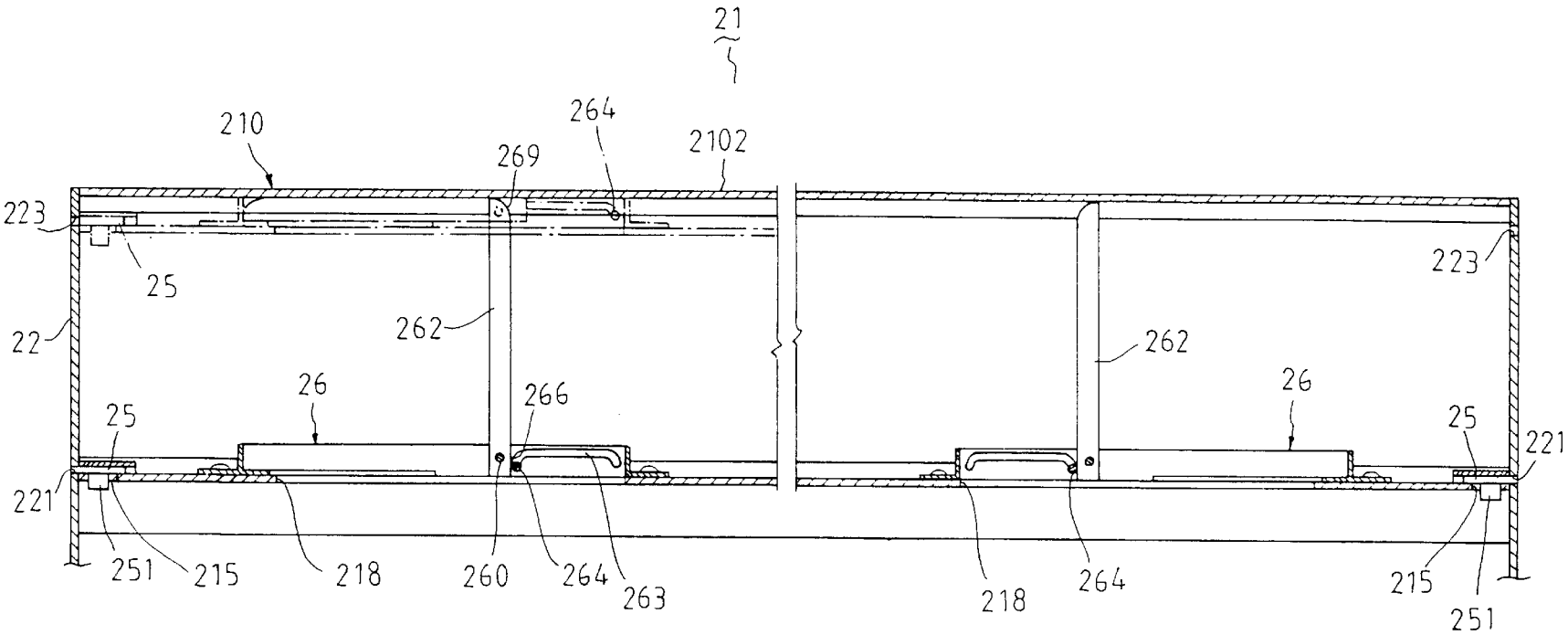
FIG. 5 is a partly sectional view of the preferred embodiment.

Moreover, the sash plate 211 further has a plurality of holes 218 formed therethrough, as shown in FIG. 5, each of which receives a pressing member 26 therein. The pressing member 26 includes a hollow mounting frame 261 mounted on an upper surface of the sash plate 211 above the hole 218, a press plate 262 which has a proximate end 2621 hinged to the mounting frame 261 by a pivot 260 and a distal bearing end 2622, and a retaining rod 264. The distal bearing end 2622 of the press plate 262 has an arcuate guiding surface 269. The retaining rod 264 is movable in two guiding slots 263 that are formed in two side walls 2612 of the mounting frame 261. A locking part 266 is provided in each of the guiding slots 263 proximate to the pivot 260 at a level lower than the pivot 260. As such, when the sash plate 211 is at the lower position, the press plate 262 is operable manually via an opening 2611 in the mounting frame 261 (see FIG. 3) and can be turned to a pressing position, where the press plate 262 is disposed uprightly relative to the mounting frame 261 such that the distal bearing end 2622 and the proximate end 2621 push the top wall 2102 and the sash plate 211, respectively. When the retaining rod 264 is moved toward the pivot 260 and is received in the locking part 266, the press plate 262 is prevented from turning downward by the retaining rod 264, thereby immobilizing the same at the pressing position.

Figure 4:
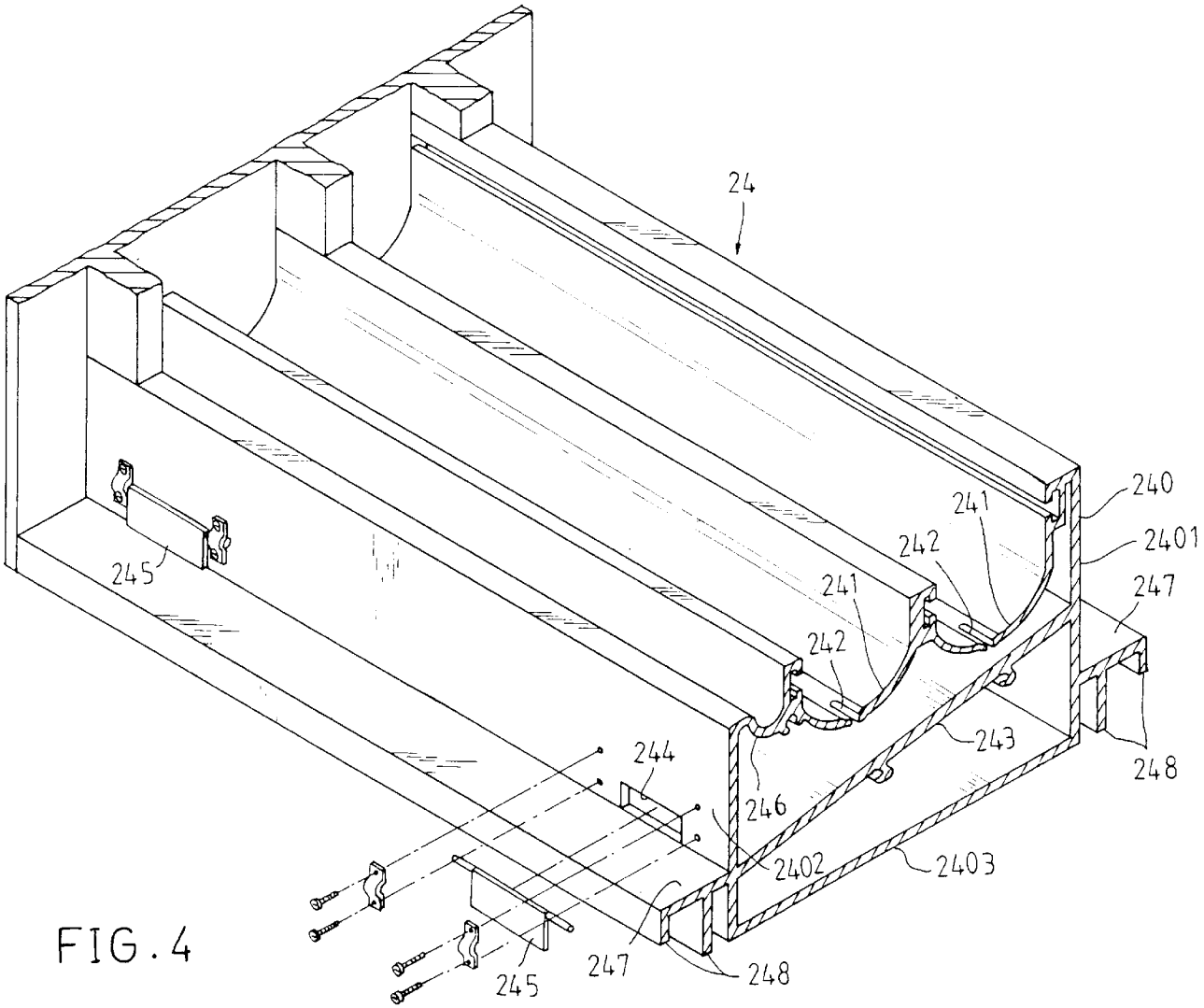
FIG. 4 is a fragmentary sectional view of a bottom jamb member employed in the preferred embodiment.

Referring to FIG. 4, the bottom jamb member 24 has a bottom channel body 240 which extends between the side jamb members 22 and which has inner and outer walls 2401, 2402, and a bottom wall 2403 to cooperatively form a channel. The bottom channel 240 has two transversely extending concave rails 241 for receiving bottom ends of the window panels 28, 29 and the window screen 27 (see FIG. 6). The concave rails 241 are provided between the inner and outer walls 2401, 2402 above the bottom wall 2403. Each of the concave rails 241 has a confining wall of an arc-shaped cross section with a water-draining hole 242 at the lowermost end thereof. An inclined partition member 243 extends from the inner wall 2401 to the outer wall 2402 between the concave rail 241 and the bottom wall 2403. A plurality of water outlet holes 244 are disposed in the outer wall 2402 at a level lower than the water draining holes 242. The inclined partition member 243 cooperates with the inner and outer walls 2401, 2402 to confine a water receiving space 2404 which is communicated with the water draining holes 242 and the water outlet holes 244. A plurality of flaps 245 are hinged on the outer wall 2402 in order to shield the water outlet holes 244, respectively. In addition, two integral anchor seats 247 extend outwardly from the inner and outer walls 2401, 2402 respectively, and have a plurality of integral anchor members 248 which extend downwardly therefrom to provide anchorage between the concrete structure 5 and the bottom jamb member 24, as shown in FIG. 6.

Referring again to FIG. 6, when the jamb frame assembly 2 is mounted on a wall 50 of the concrete structure, concrete can be applied thereto until the surface of the applied layer is flush with the outer anchor members 219, 248. As illustrated in FIG. 5, the latch member 25 can be released from the side jamb members 22 by moving the handle portion 251 away from the latch holes 221. Each of the press plates 262 is normally in a horizontal position by resting on support layers 265 which extend inwardly from the mounting frame 26, as shown in FIG. 3. At such, the sash plate 211 can be moved upwardly to the upper position. The window screen 27 and the window panels 28, 29 can be loaded easily into the jamb frame assembly 2 between the top and bottom jamb members 21, 24. After the window panels 28, 29 are loaded, the sash plate 211 is moved in the longitudinal direction, and the press plate 262 is placed in the pressing position via the retaining rod 264. The latch members 25 are inserted into the lower latch holes 211, respectively. A gap of only 1 mm is provided between the sash plate 211 and the windowpanels 28, 29 to permit the windowpanels 28, 29 to slide smoothly. Moreover, the window panels 28, 29 are provided with rollers 281, 291 at the bottom portion thereof so that the distance between the bottom ends of the window panels 28, 29 and the bottom concave rail 241 is reduced to 1 mm. As such, sealing can be made easily to prevent intrusion of water and dust, and the height of the inner wall 2401 of the bottom jamb member 24 maybe reduced. Water entering the jamb frame assembly 2 can be directed toward the water outlet holes 244 by virtue of the draining holes 242 and the inclined partition member 243.

Figure 7:
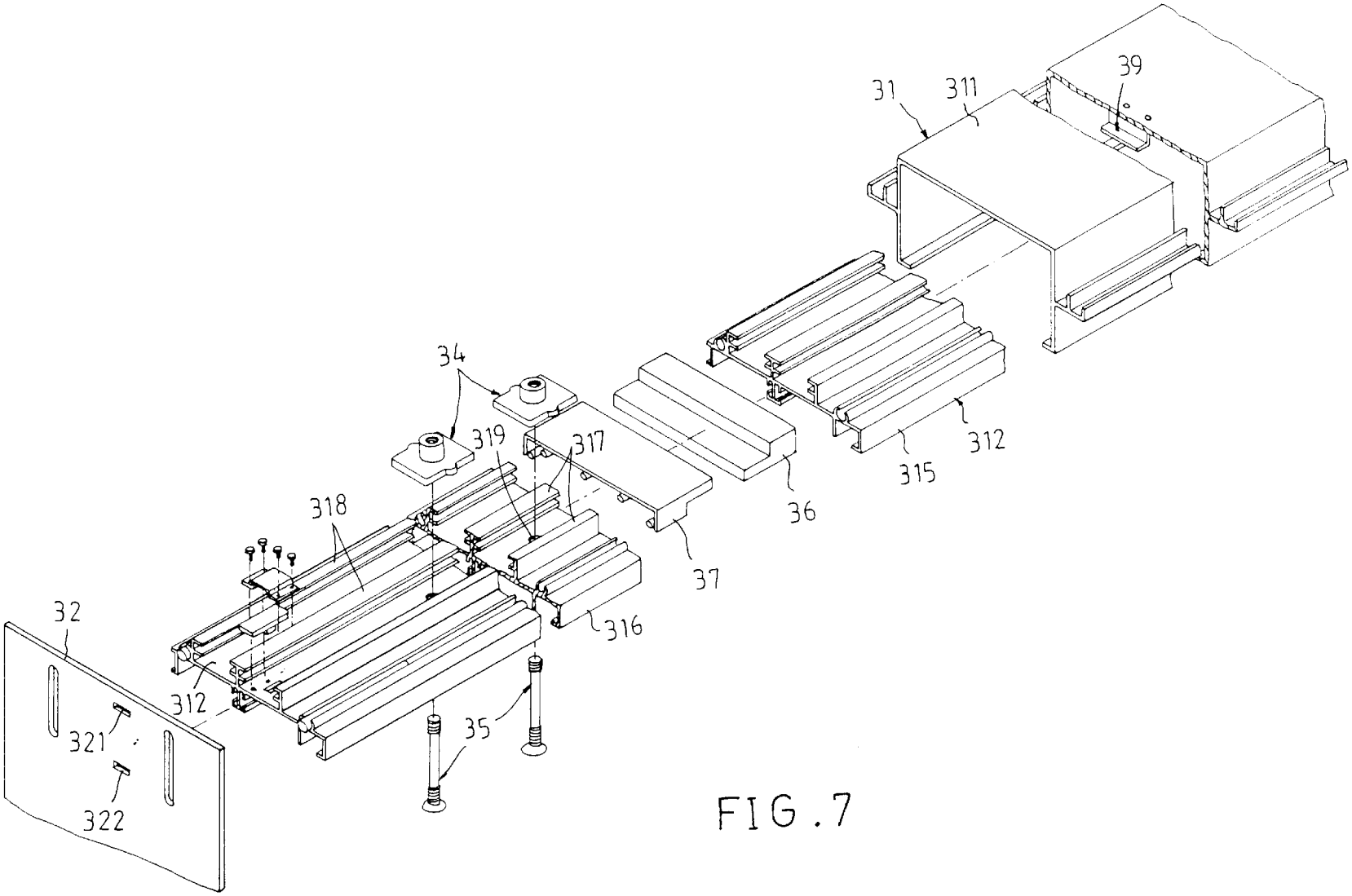
FIG. 7 is a partly exploded view of a modified preferred embodiment of this invention.
Figure 8:
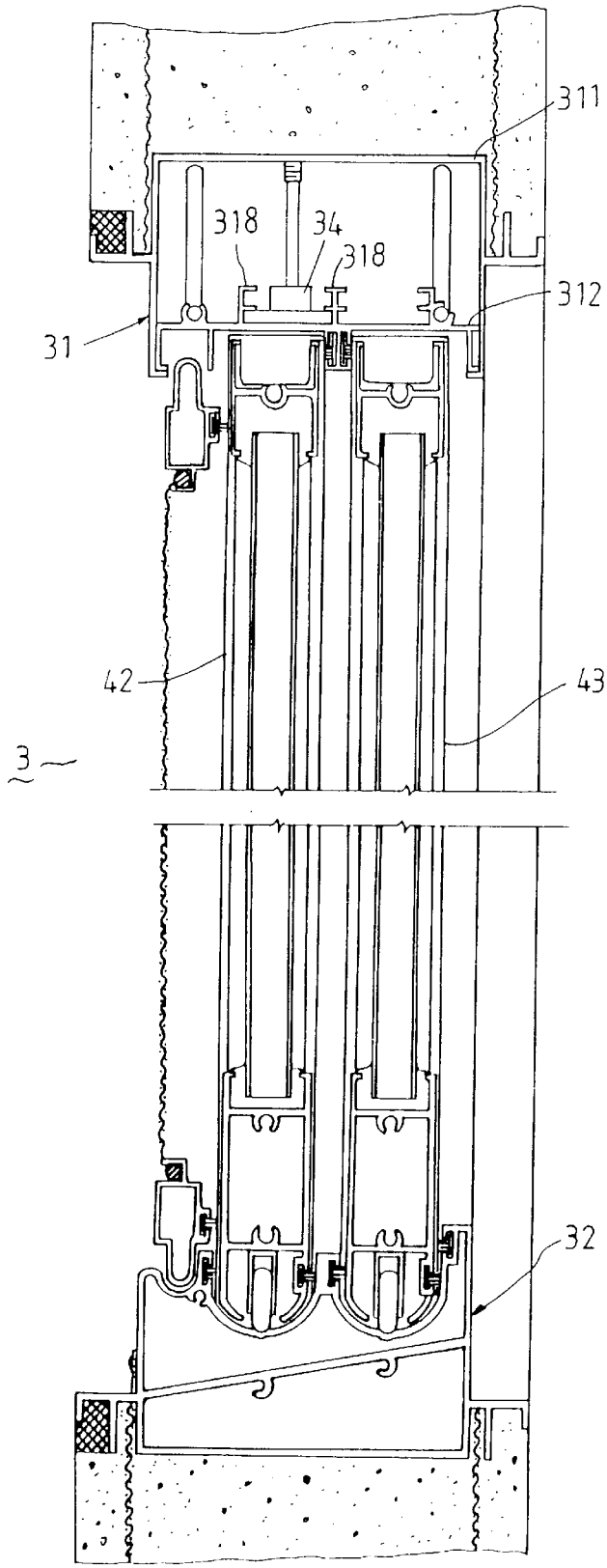
FIG. 8 is a side view of the modified preferred embodiment when mounted in an opening of an upright wall.
Figure 9:
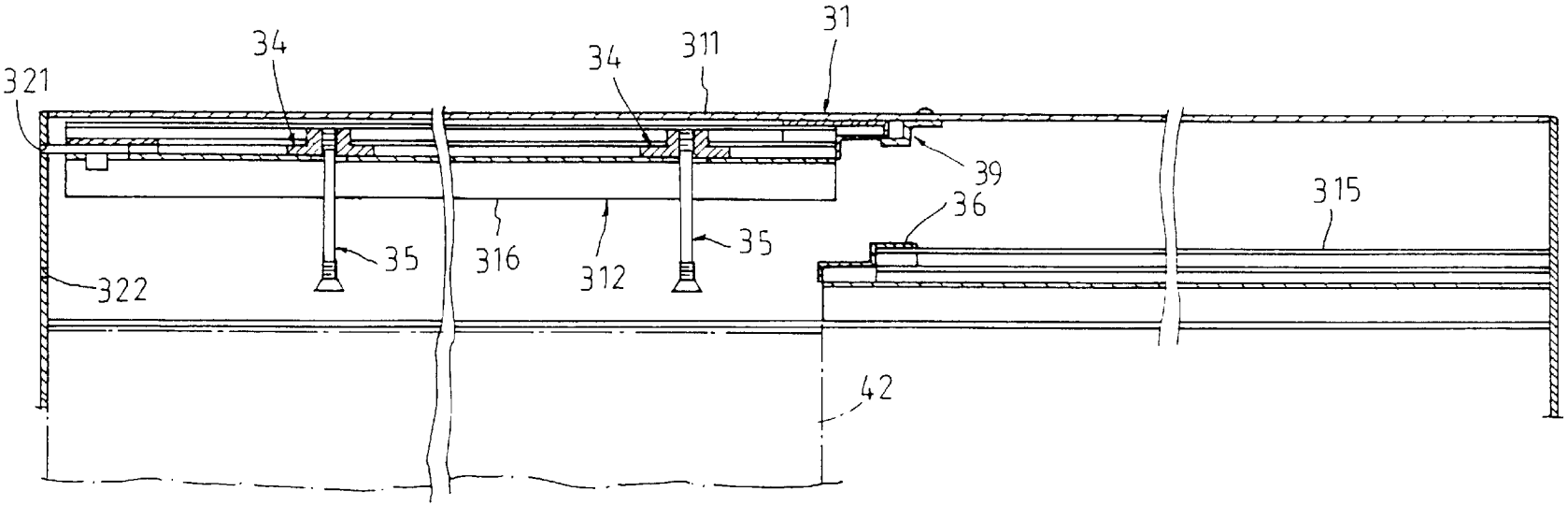
FIG. 9 shows how the sash plate in the modified preferred embodiment is moved between upper and lower positions.

Referring to FIGS. 7, 8 and 9, a second preferred embodiment is shown to be generally similar to the previous embodiment except in that the sash plate 312 includes a movable left sash portion 316 and a stationary right sash portion 315. The left sash portion 316 preferably has a length in the transverse direction greater than or equal to that of the window panel 42, 43 so as to facilitate loading or unloading of the latter when the left sash portion 316 is at the upper position. The left sash portion 316 has two bolt retention seats 34 which are disposed on an upper surface thereof, each of which is formed with a retention bore in the longitudinal direction. The left sash portion 316 further has two through holes 319 respectively aligned with the retention bores in the bolt retention seats 34. Two retention bolts 35 are inserted from a bottom side of the left sash portion 316 to extend through the through holes 319 of the left sash portion 316 and are threaded longitudinally through the retention bores in the bolt retention seats 34. Note that the retention bolts 35 are turnable longitudinally to move the left sash portion 316 between the upper and lower positions. In this embodiment, the left sash portion 316 has a pair of retention rails 317 transversely formed on the upper surface thereof to receive the retention seats 34 therebetween.

An important aspect to note is that an engaging member 37 is disposed slidably on another pair of retention rails 38 which, in turn, are disposed on the upper surface of the left sash portion 316. The engaging member 37 can be moved rightwardly to engage a hook member 39 which is fixed to the top wall 311 of the top channel body 31 in alignment with the upper latch hole 321 in the left side jamb member 32. A retention member 36 conforming to the engaging member 37 is disposed on a left end of the stationary right sash portion 315 in alignment with the lower latch hole 322 that is formed in the left side jamb member 32 such that the engaging member 37 can be retained on the retention member 36 when the right sash portion 315 is at the lower position.

With this invention thus explained, it is apparent that numerous modifications and variations can be made without departing from the scope and spirit of this invention. It is therefore intended that this invention be limited only as indicated in the appended claims.

I claim:

1. A sliding-type window frame for mounting a window panel assembly, the window frame comprising:

a jamb frame assembly including a top jamb member, a bottom jamb member spaced apart from said top jamb member in a longitudinal direction, a latch mechanism for positioning said sash plate at said lower and upper positions, said latch member mounted slidably on said sash plate proximate to one of said side jamb members, a lower latch hole and an upper latch hole formed in said side jamb member to releasably receive an engaging end of said latch member when said sash plate is at said upper and lower positions, left and right upright side jamb members spaced apart from each other in a transverse direction relative to said longitudinal direction and interconnecting said top and bottom jamb members;

said top jamb member having a top channel body that confines a space adapted for receiving a top end of the window panel assembly and that has two opposite ends connected to said side jamb members respectively, and a sash plate extending between said side jamb members and mounted movably in said top channel body so as to be movable in said space between lower and upper positions, said sash plate having a lower surface formed with at least one track member adapted to engage the top end of the window panel assembly when said sash plate is at said lower position, said track member being disposed to be spaced away from the top end of the window panel assembly when said sash plate at said upper position to facilitate loading and unloading of the window panel assembly into and from said jamb frame assembly.

2. The sliding-type window frame as defined in claim 1, further comprising a guide for guiding said sash plate to move in said longitudinal direction without tilting.

3. The sliding-type window frame as defined in claim 2, wherein said guide further includes two vertical guide slots provided respectively in said side jamb members, and two engagement members projecting from two opposing ends of said sash plate towards said side jamb members so as to slide in said guide slots.

4. A sliding-type window frame for mounting a window panel assembly, the window frame comprising:

a jamb frame assembly including a top jamb member, a bottom jamb member spaced apart from said top jamb member in a longitudinal direction, a latch mechanism for positioning said sash plate at said lower and upper positions, left and right upright side jamb members spaced apart from each other in a transverse direction relative to said longitudinal direction and interconnecting said top and bottom jamb members;

said top jamb member having a top channel body that confines a space adapted for receiving a top end of the window panel assembly and that has two opposite ends connected to said side jamb members respectively, and a sash plate extending between said side iamb members and mounted movably in said top channel body so as to be movable in said space between lower and upper positions, said sash plate having a lower surface formed with at least one track member adapted to engage the top end of the window panel assembly when said sash plate is at said lower position, said track member being disposed to be spaced away from the top end of the window panel assembly when said sash plate at said upper position to facilitate loading and unloading of the window panel assembly into and from said jamb frame assembly, said top channel body has a top wall extending above said sash plate, and two opposite guide walls extending downwardly from two opposite ends of said top wall, said guide walls having inwardly projecting end flanges, said sash plate being moveable between said end flanges and said top wall, and a pressing member which is mounted on said sash plate for pressing downward said sash plate against the top end of the window panel assembly when said sash plate is at said upper position.

5. The sliding-type window frame as defined in claim 4, wherein said pressing member includes a mounting frame mounted on said sash plate, and a press plate having a proximate end hinged to said mounting frame, and a distal bearing end, said sash plate being turnable to a pressing position where said press plate turns upright from said mounting frame such that said distal bearing end and said proximate end push said top wall and said sash plate, respectively.

6. The sliding-type window frame as defined in claim 5, wherein said pressing member has a retaining member for retaining said press plate in said pressing position.

7. A sliding-type window frame for mounting a window panel assembly, the window frame comprising:

a jamb frame assembly including a top jamb member, a bottom jamb member spaced apart from said top jamb member in a longitudinal direction, and left and right upright side jamb members spaced apart from each other in a transverse direction relative to said longitudinal direction and interconnecting said top and bottom jamb members;

said top jamb member having a top channel body that confines a space adapted for receiving a top end of the window panel assembly and that has two opposite ends connected to said side jamb members respectively, and a sash plate extending between said side jamb members and mounted movably in said top channel body so as to be movable in said space between lower and upper positions, said sash plate having a lower surface formed with at least one track member adapted to engage the top end of the window panel assembly when said sash plate is at said lower position, said track member being disposed to be spaced away from the top end of the window panel assembly when said sash plate at said upper position to facilitate loading and unloading of the window panel assembly into and from said iamb frame assembly, wherein said bottom jamb member has a bottom channel body which extends between said side jamb members and which has at least one transversely extending concave rail for receiving a bottom end of the window panel assembly, said concave rail having a confining wall of an arc-shaped cross-section, and a water draining hole at a lowermost end of said confining wall.

8. The sliding-type window frame as defined in claim 7, wherein said bottom channel body has inner and outer walls and a bottom wall which cooperate to form a channel, said concave rail being provided between said inner and outer walls above said bottom wall, said bottom channel body further having an inclined partition member extending from said inner wall to said outer wall between said concave rail and said bottom wall, said outer wall having a water outlet hole disposed at a level lower than said water draining hole, said partition member cooperating with said inner and outer walls to confine a water receiving space that is communicated with said water draining hole and said water outlet hole and inclining downwardly and outwardly so as to be adapted to direct water to flow toward said water outlet hole.

9. The sliding-type window frame as defined in claim 7, further comprising integral anchors which project outwardly from said top and bottom channel bodies.

10. A sliding-type window frame for mounting a window panel assembly, the window frame comprising:

a jamb frame assembly including a top jamb member, a bottom jamb member spaced apart from said top jamb member in a longitudinal direction, a latch mechanism for positioning said sash plate at said lower and upper positions, left and right upright side jamb members spaced apart from each other in a transverse direction relative to said longitudinal direction and interconnecting said top and bottom jamb members;

said top jamb member having a top channel body that confines a space adapted for receiving a top end of the window panel assembly and that has two opposite ends connected to said side jamb members respectively, and a sash plate extending between said side jamb members and mounted movably in said top channel body so as to be movable in said space between lower and upper positions, said sash plate having a lower surface formed with at least one track member adapted to engage the top end of the window panel assembly when said sash plate is at said lower position, said track member being disposed to be spaced away from the top end of the window panel assembly when said sash plate at said upper position to facilitate loading and unloading of the window panel assembly into and from said jamb frame assembly, a pressing member which is mounted on said sash plate for pressing downward said sash plate against the top end of the window panel assembly when said sash plate is at said upper position, wherein said pressing member includes a bolt retention seat disposed on an upper surface of said sash plate and formed with a retention bore, and a retention bolt extending threadedly and longitudinally through said retention ore of said bolt retention seat, said sash plate having a through hole aligned with said retention bore so that said retention bolt can be inserted from a bottom side of said sash plate and can be turned longitudinally to move said sash plate in said longitudinal direction between said upper and lower positions.

11. The sliding-type window frame as defined in claim 10, wherein said sash plate further has a pair of retention rails transversely formed on said upper surface of said sash plate to receive said retention seat therebetween.

* * * * *